United States Patent [19]

Bruggemeier

[11] Patent Number: 4,953,311

[45] Date of Patent: Sep. 4, 1990

[54] GOLF SHOES AND INSERTS FOR GOLF SHOES

[76] Inventor: Fred H. Bruggemeier, 1020 Aoloa Pl., #309-B, Kailua, Hi. 96734

[21] Appl. No.: 351,409

[22] Filed: May 12, 1989

[51] Int. Cl.[5] ..... A43B 13/38

[52] U.S. Cl. ..... 36/127; 36/43

[58] Field of Search ..... 36/127, 134, 117; 273/32 C, 187 B, 188 A; 128/584, 585

[56] References Cited

U.S. PATENT DOCUMENTS

| | | | |
|---|---|---|---|
| 2,189,613 | 2/1940 | Paulsen | 273/187 B |
| 3,955,821 | 5/1976 | Spedding | 273/187 B |
| 4,149,324 | 4/1979 | Lesser et al. | 139/127 |
| 4,372,062 | 2/1983 | Tringali | 36/117 X |
| 4,819,940 | 4/1989 | Davis | 273/187 B |

FOREIGN PATENT DOCUMENTS

| | | | |
|---|---|---|---|
| 874056 | 10/1981 | U.S.S.R. | 128/585 |

*Primary Examiner*—Paul T. Sewell
*Assistant Examiner*—Andrew D. Meyers
*Attorney, Agent, or Firm*—Martin E. Hsia

[57] ABSTRACT

A pair of golf shoes or inserts for golf shoes is provided in which, for a right handed golfer, the heel of the right foot is canted to the left, and the instep of the left foot is also canted to the left. The shoes or inserts are asymmetrically designed to optimize the different functions performed by a golfer's feet and to improve a golfer's balance and body position during a golf swing.

36 Claims, 3 Drawing Sheets

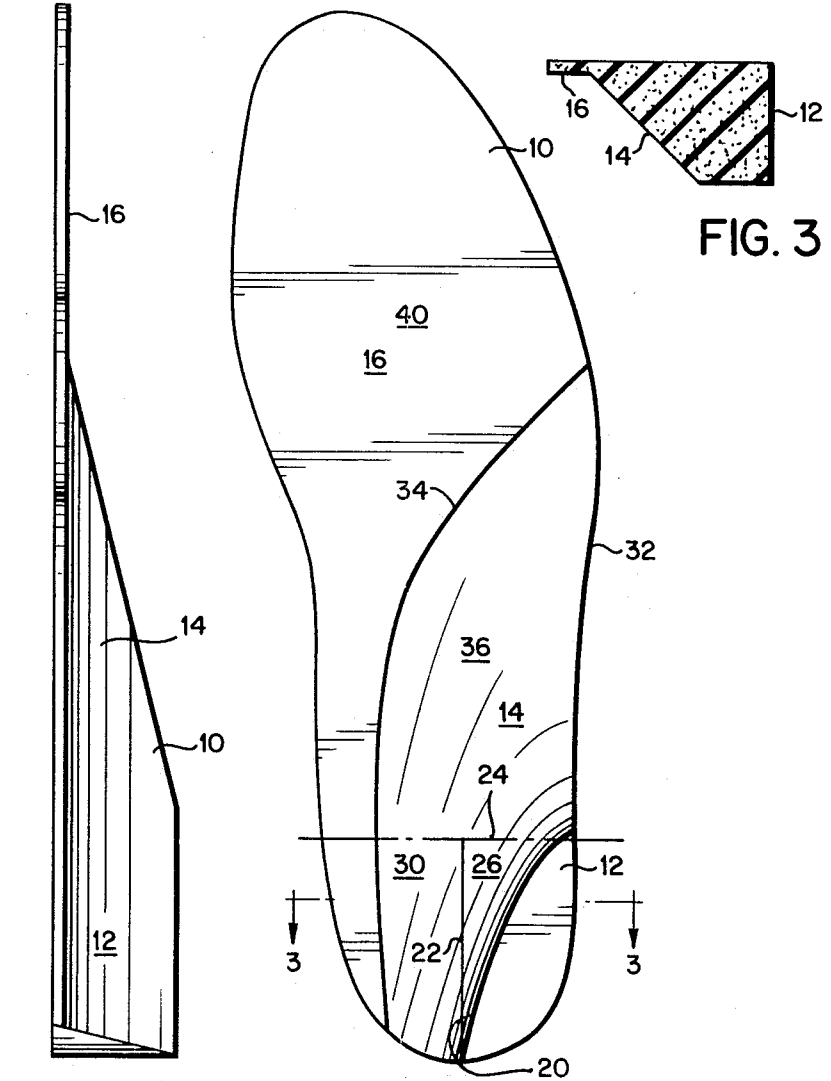
FIG. 1
FIG. 2
FIG. 3
10
12
14
16
20
22
24
26
30
32
34
36
40
3
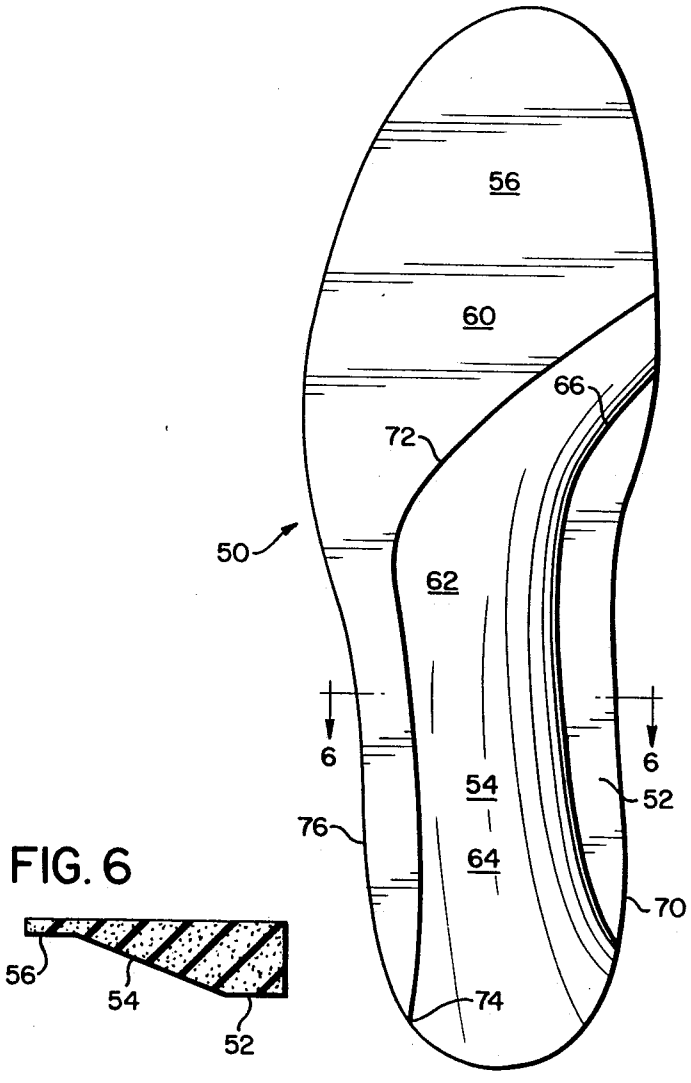
FIG. 4
FIG. 5
FIG. 6
50
52
54
56
60
62
64
66
70
72
74
76
6

FIG. 10
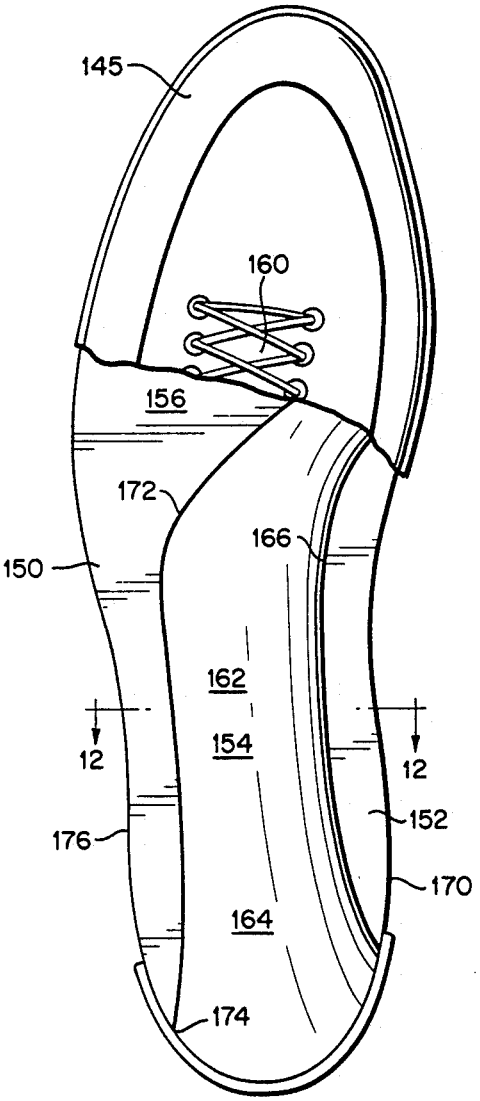
FIG. 11
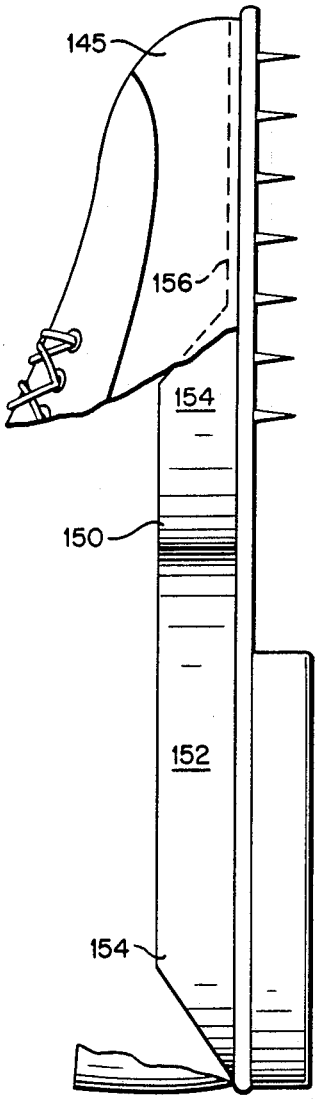
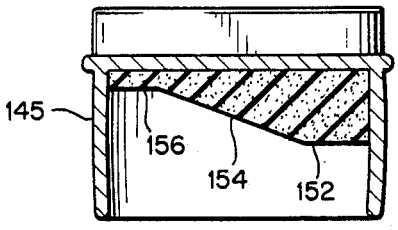
FIG. 12

GOLF SHOES AND INSERTS FOR GOLF SHOES

BACKGROUND OF THE INVENTION

This invention relates to golf shoes and inserts for golf shoes to improve the balance and body position of a golfer during a golf swing.

It has long been recognized that one of the most important skills in the game of golf is a proper body position. However, it also has been recognized that most golfers have difficulty in executing a golf swing properly due to improper body position. Many solutions have been proposed to this problem.

U.S. Pat. No. 2,847,769 issued to Schlesinger teaches the use of built-up soles on golf shoes that cant a golfer's feet toward each other. U.S. Pat. No. 2,855,704 also issued to Schlesinger teaches a pair of golf shoes that cant a golfer's feet together, but also provide the ability to use the shoes for normal walking.

U.S. Pat. No. 3,951,407 issued to Calacurcio teaches a wedge-shaped device for elevating the outside edge of a golfer's shoe and is also collapsible to allow normal walking.

U.S. Pat. No. 4,073,075 issued to O'Brien teaches a wedge-shaped removable member that cants the rear foot of the golfer toward the target. U.S. Pat. No. 4,118,034 also issued to O'Brien provides a similar device.

U.S. Pat. No. 4,685,227 issued to Simmons teaches a pair of golf shoes with soles that cant a golfer's feet toward each other, and U.S. Pat. No. 4,682,425 also issued to Simmons teaches adapters for golf shoes to cant a golfer's feet together.

All of the foregoing devices are directed to solving the same problem as the present invention, but teach that the solution is to cant the feet of the golfer together or to cant the rear foot of the golfer towards the target in the case of Calacurcio or O'Brien. However, as indicated in the patents to Simmons, the prior patents to Schlesinger and O'Brien have not solved the problem of a golfer's proper stance and Simmons itself also teaches that the feet of a golfer should be canted towards each other. None of the foregoing devices teaches any modification of the shoe or insert for the front foot of a golfer during a swing, except to cant the front foot symmetrically with the rear foot, as is taught by Simmons and Schlesinger. Thus, the shoe or insert for the front foot is not optimized for the different function to be performed by the front foot during a golf swing.

It is therefore an object of this invention to provide golf shoes and inserts for golf shoes to improve the balance and body position of a golfer during a golf swing.

It is a further object of the invention to provide such a pair or shoes and inserts that will allow a golfer to walk normally.

It is a still further object of the invention to provide golf shoes and inserts for golf shoes in which each shoe is configured to optimize the different functions performed by each foot during a golf swing.

SUMMARY OF THE INVENTION

These and other objects are achieved by an asymmetric pair of inserts for golf shoes or golf shoes. For a right-handed golfer, the right insert (or the insole of the right golf shoe) has a maximum thickness (or height) in a rightward and rearward portion of the heel area, and the left insert (or the insole of the left golf shoe) has a maximum thickness (or height) in a rightward portion of the instep area. The maximum thickness (or height) of the right insert (or insole of the right golf shoe) is preferably greater than the maximum thickness (or height) of the left insert (or insole of the left golf shoe).

For a right-handed golfer, only the heel of the right foot is canted towards the left by the shoe or insert, thereby tending to prevent the golfer's body weight from shifting to the right during the backswing, increasing the golfer's height and providing a surface to push against during the downswing with greater leverage. This canting and elevation of the right foot also keeps the right foot's weight on the inside of the right foot and keeps pressure on the inside of the right knee for better control.

For a right-handed golfer, the left shoe or insert cants the instep area of the left foot towards the left but to a lesser degree than the canting of the right foot. This allows the center of gravity of the golfer to pass through the plane defined by the golf ball and the golf club before the impact between the golf club and the ball, thereby allowing the body weight of the golfer to be driven through the ball.

Obviously, for a left-handed golfer, the left heel would be canted to the right and the instep area of the right foot also would be canted to the right.

The shoes and inserts would preferably be constructed of a relatively resilient or pliant material to allow a golfer to walk relatively normally with the shoes or inserts in place. However, the shoes and inserts are intended for use only in practice and not for use while playing golf unless a qualified medical professional examines the individual golfer and determines that he or she can use the inserts or shoes for extended walking.

The asymmetry of design, both in the direction of canting and in the areas of the foot that are canted, allows each of the inserts or shoes to be optimally designed for the function of the particular foot. Thus, the right foot insert keeps the body weight from shifting backwards during the backswing and gives leverage during the downswing. As indicated above, it also provides additional height and a surface to push against during the downswing. The right foot's weight is also kept on the inside of the right foot for better balance and pressure is kept on the inside of the right knee for control. Thus, the right foot insert is optimized for leverage and power in the downswing.

The left foot insert is optimized for the portion of the swing when the club is driven through the golf ball. The left shoe or insert allows the center of gravity of the golfer to pass through the ball before the impact of the clubhead with the ball and avoids impact with the ball before the center of gravity reaches the ball. This allows the body weight to be driven through the ball for better distance.

BRIEF DESCRIPTION OF THE DRAWINGS

FIG. 1 is a top view of an insert for a right golf shoe for a right handed golfer in accordance with this invention;

FIG. 2 is a side view of FIG. 1;

FIG. 3 is a cross-sectional view through the plane 3—3 of FIG. 1;

FIG. 4 is a top view of an insert for a left golf shoe for a right handed golfer in accordance with this invention;

FIG. 5 is a side view of FIG. 4;

FIG. 6 is a cross-sectional view through the plane 6—6 of FIG. 4;

FIG. 10 is a cut-away top view of a left golf shoe for a right handed golfer in accordance with this invention;

FIG. 11 is a cut-away side view of FIG. 10; and

FIG. 12 is a cross-sectional view through the plane 12—12 of FIG. 10.

DETAILED DESCRIPTION OF PREFERRED EMBODIMENTS

Figure 8:
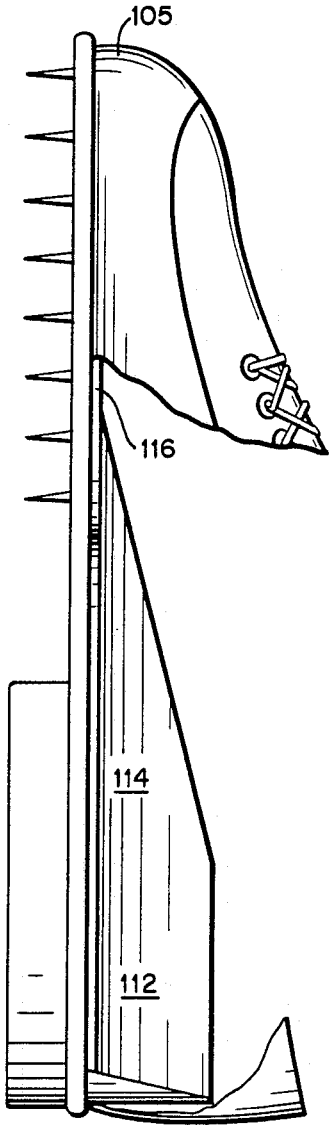
FIG. 8 is a cut-away side view of FIG. 7.

Referring to FIG. 1, a right insert 10 for a right handed golfer in accordance with the invention is shown. The right insert 10 contains three areas: a platform area 12, a tapering area 14 and a minimum thickness area 16.

The platform area 12 is the area of maximum thickness, the minimum thickness area 16 is the area of minimum thickness, and the tapering area 14 is the area where the maximum thickness tapers to the minimum thickness. The platform area 12 is defined by a platform area curve 20, which commences at the rearmost point of a heel bisecting line 22 that substantially bisects the heel 24 into a right heel section 26 and a left heel section 30. The platform area curve 20 extends forward and curves to the right and terminates at a point on the right edge 32 just forward of the right heel section 26.

The tapering area 14 tapers to a minimum thickness from the platform area 12 to the minimum thickness area 16 at a minimum thickness line 34. The rearmost portion of the minimum thickness line 34 substantially bisects the left heel section 30 and extends forwardly across the heel 24 and across approximately half of the instep 36 and then curves rightwardly and terminates on the right edge 32 at a point in the ball 40.

The minimum thickness area 16 covers the remainder of the right insert 10.

For a men's size 9 right golf shoe, the thickness of the platform area 12 is preferably approximately 1¼ inches and the thickness of the minimum thickness area 16 is approximately ⅛ of an inch. Preferably also, the platform area 12 should be approximately 1 inch wide at its widest point, and the platform area 12 should be approximately 2⅜ inches long. Further, the tapering area preferably should extend only approximately 7¼ inches from front to rear.

Preferably, the combined width of the platform area 12 and the tapering area 14 from the right edge 32 to the minimum thickness line 34 is a maximum of 2⅛ inches.

FIG. 2 shows a side view of the invention 10 showing the platform area 12 tapering forwardly through the tapering area 14 into the minimum thickness area 16.

FIG. 3 is a cross sectional view of FIG. 1 taken through the plane 3—3 of FIG. 1 showing the platform area 12 tapering leftwardly through the tapering area 14 into the minimum thickness area 16.

FIG. 4 shows a left insert 50 for a right handed golfer in accordance with this invention. The left insert includes a ridge area 52, a tapering area 54 and a minimum thickness area 56. The ridge area 52 covers only a rearward and rightward portion of the ball 60, a rightward portion of the instep 62 and a forward and rightward portion of the heel 64 to the right of a ridge area curve 66 that commences from a point approximately half way up the heel 64 on the right edge 70 of the left insert 50 and extends forwardly and to the left through the remainder of the heel 64 and then forwardly through the instep 62 and then curves rightwardly in the ball 60 until it terminates at the right edge 70. The tapering area 54 extends to the left from the ridge area line 66 to a minimum thickness line 72. The minimum thickness line 72 commences from a rearward point 74 on the left edge 76 in the heel 64 and extends approximately parallel to the left edge 76 for approximately half of the instep 62 and then curves to the right through the instep 62 and the ball 60 until it terminates on the right edge 70.

FIG. 5 is a side view of FIG. 4 showing the ridge area 52 tapering forwardly through the tapering area 54 to the minimum thickness area 56. This figure also shows the ridge area 52 tapering rearwardly through the tapering area 54 to the rear of the left insert 50.

FIG. 6 is a view of FIG. 4 through the section 6—6 showing the ridge area 52 tapering leftwardly through the tapering area 54 to the minimum thickness area 56.

For a men's size 9 left golf shoe, the ridge area 52 is preferably approximately ¾ of an inch thick and approximately 5⅞ inches long, with the tapering area 54 extending rearwardly from the ridge area 52 approximately 1¼ inches to the rear of the left insert 50 and extending forwardly from the ridge area 52 approximately 13/16 of an inch to the minimum thickness area 56. The minimum thickness area 56 is preferably approximately ⅛ inch thick. Across the instep 62, the ridge area 52 is approximately 9/16 of an inch wide and the tapering area 54 is approximately 1½ inches wide. Preferably the tapering area 54 extends approximately 4 13/16 inches from the rearward point 74 until it commences curving to the right.

Preferably the inserts 10 and 50 are both made of a resilient material that will compress when a golfer is walking so as to allow normal walking. Foam rubber or polyurethane foam would be appropriate materials for the practice of the invention. It is also preferable that the inserts 10 and 50 be made of a resilient material so that they can be flexed for insertion into a golfer's shoes.

Of course the dimensions and the materials for the invention should be adjusted to conform to the different sizes of golf shoes and the degree of resilience desired.

Figure 7:
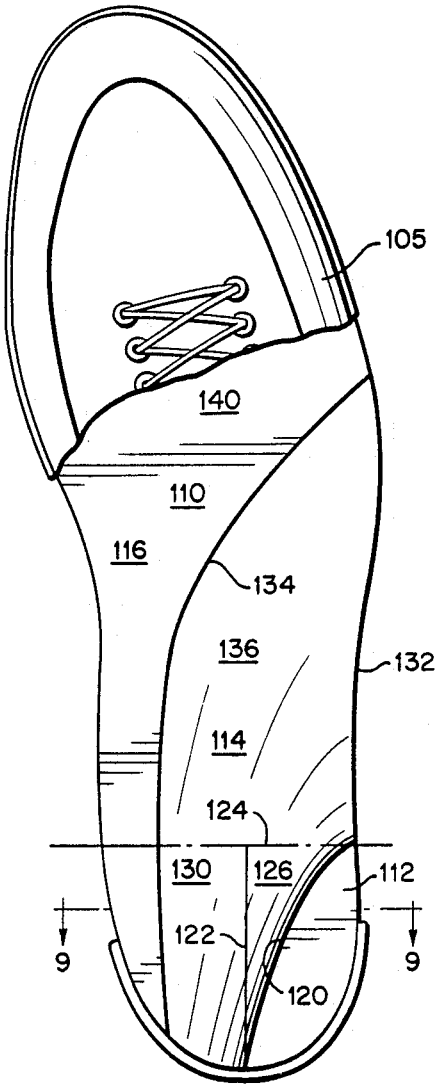
FIG. 7 is a cut-away top view of a right golf shoe for a right handed golfer in accordance with this invention.

Referring to FIG. 7, a right golf shoe 105 for a right handed golfer in accordance with the invention is shown, with the top cut away to show the right insole 110. The right insole 110 contains three areas: a platform area 112, a tapering area 114 and a minimum height area 116.

The platform area 112 is the area of maximum height, the minimum height area 116 is the area of minimum height, and the tapering area 114 is the area where the maximum height tapers to the minimum height. The platform area 112 is defined by a platform area curve 120, which commences at the rearmost point of a heel bisecting line 122 that substantially bisects the heel 124 into a right heel section 126 and a left heel section 130. The platform area curve 120 extends forward and curves to the right and terminates at a point on the right edge 132 just forward of the right heel section 126.

The tapering area 114 tapers to a minimum height from the platform area 112 to the minimum height area 116 at a minimum height line 134. The rearmost portion of the minimum height line 134 substantially bisects the left heel section 130 and extends forwardly across the heel 124 and across approximately half of the instep 136 and then curves rightwardly and terminates on the right edge 132 at a point in the ball 140.

The minimum height area 116 covers the remainder of the right insole 110.

For a men's size 9 right golf shoe, the height of the platform area 112 is preferably approximately 1⅛ inch higher than the height of the minimum height area 116. Preferably also, the platform area 112 should be approximately 1 inch wide at its widest point, and the platform area 112 should be approximately 2⅜ inches long. Further, the tapering area preferably should extend only approximately 7¼ inches from front to rear.

Preferably, the combined width of the platform area 112 and the tapering area 114 from the right edge 132 to the minimum height line 134 is a maximum of 2⅛ inches.

FIG. 8 shows a side view of the right golf shoe 105 showing the platform area 112 tapering forwardly through the tapering area 114 into the minimum height area 116.

Figure 9:
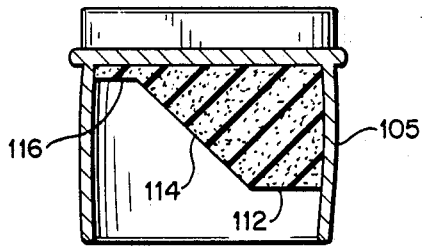
FIG. 9 is a cross-sectional view through the plane 9—9 of FIG. 7.

FIG. 9 is a cross sectional view of FIG. 7 taken through the plane 9—9 of FIG. 7 showing the platform area 112 tapering leftwardly through the tapering area 114 into the minimum height area 116.

FIG. 10 shows a left golf shoe 145 for a right handed golfer in accordance with this invention, with the top cut away to show the left insole 150. The left insole 150 includes a ridge area 152, a tapering area 154 and a minimum height area 156. The ridge area 152 covers only a rearward and rightward portion of the ball 160, a rightward portion of the instep 162 and a forward and rightward portion of the heel 164 to the right of a ridge area curve 166 that commences from a point approximately half way up the heel 164 on the right edge 170 of the left insole 150 and extends forwardly and to the left through the remainder of the heel 164 and then forwardly through the instep 162 and then curves rightwardly in the ball 160 until it terminates at the right edge 170. The tapering area 154 extends to the left from the ridge area line 166 to a minimum height line 172. The minimum height line 172 commences from a rearward point 174 on the left edge 176 in the heel 164 and extends approximately parallel to the left edge 176 for approximately half of the instep 162 and then curves to the right through the instep 162 and the ball 160 until it terminates on the right edge 170.

FIG. 11 is a side view of FIG. 10 showing the ridge area 152 tapering forwardly through the tapering area 154 in the ball 160 to the minimum height area 156. This figure also shows the ridge area 152 tapering rearwardly through the tapering area 154 to the rear of the left insole 150.

FIG. 12 is a view of FIG. 10 through the section 12—12 showing the ridge area 152 tapering leftwardly through the tapering area 154 to the minimum height area 156.

For a men's size 9 left golf shoe, the ridge area 152 is preferably approximately ⅝ inch higher than the minimum height area 156 and approximately 5⅞ inches long, with the tapering area 154 extending rearwardly from the ridge area 152 approximately 1½ inches to the rear of the left insole 150 and extending forwardly from the ridge area 152 approximately 13/16 of an inch to the minimum height area 156. Across the instep 162, the ridge area 152 is approximately 9/16 of an inch wide and the tapering area 154 is approximately 1½ inches wide. Preferably the tapering area 154 extends approximately 4 13/16 inches from the rearward point 174 until it commences curving to the right.

Preferably the insoles 110 and 150 are both made of a resilient material that will compress when a golfer is walking so as to allow normal walking. Foam rubber or polyurethane foam would be appropriate materials for the practice of the invention.

Of course the dimensions and the materials for the invention should be adjusted to conform to the different sizes of golf shoes and the degree of resilience desired.

Although the invention has been described in connection with a specific embodiment, no limitations are to be inferred except for those set forth in the appended claims.

What is claimed is:

1. A right insert and a left insert for a pair of golf shoes for a right handed golfer, said right insert having a right heel area and a right instep area and said left insert having a left heel area and a left instep area, comprising:

a right insert having a right maximum thickness in a rightward and rearward portion of said right heel area; and a left insert having a left maximum thickness in a rightward portion of said left instep area.

2. A right insert and a left insert, as described in claim 1, wherein said right maximum thickness is approximately 1¼ inches and said left maximum thickness is approximately ¾ inches.

3. A right insert and a left insert, as described in claim 2, wherein said right insert and said left insert are formed of a resilient material.

4. A right insert and a left insert, as described in any of claims 1, 2 or 3, wherein said right insert tapers from said right maximum thickness leftwardly across only a portion of said right heel area to a right minimum thickness and wherein said left insert tapers from said left maximum thickness leftwardly across only a portion of said left instep area to a left minimum thickness.

5. A right insert and a left insert, as described in claim 4, wherein said right minimum thickness and said left minimum thickness are both approximately ⅛ inch.

6. A right golf shoe having a right insole and a left golf shoe having a left insole for a right handed golfer, said right insole having a right heel area and a right instep area and said left insole having a left heel area and a left instep area, comprising:

a right golf shoe, wherein said right insole has a right maximum height in a rightward and rearward portion of said right heel area; and a left golf shoe, wherein said left insole has a left maximum height in a rightward portion of said left instep area.

7. A right golf shoe and a left golf shoe, as described in claim 6, wherein:

said right maximum height is approximately 1⅛ inches; and said left maximum height is approximately ⅝ inch.

8. A right golf shoe and a left golf shoe, as described in claim 6 or 7, wherein said right insole tapers from said right maximum height leftwardly across only a portion of said right heel area to a right minimum height and wherein said left insole tapers from said left maximum height leftwardly across only a portion of said left instep area to a left minimum height.

9. A right golf shoe and a left golf shoe, as described in claim 8, wherein said right insole and said left insole are formed of a resilient material.

10. A right insert and a left insert for a pair of golf shoes for a right handed golfer, each of said inserts having a heel area, an instep area, a ball area, a left edge and a right edge, comprising:

a right insert formed to fit inside a right golf shoe having a uniform right maximum thickness in a platform area in said heel area of said right insert, said platform area covering a rightward and rearward portion of said heel area of said right insert, said right insert tapering to a right minimum thickness leftwardly across a portion of said heel area of said right insert; and a left insert formed to fit inside a left golf shoe having a uniform left maximum thickness in a ridge area adjacent to said right edge of said left insert, said ridge area covering a rightward portion of said instep area of said left insert, said left insert tapering to a left minimum thickness leftwardly across a portion of said instep area of said left insert.

11. A right insert and a left insert as described in claim 10, wherein:

said right insert tapers to said right minimum thickness forwardly across said instep area of said right insert and a rearward portion of said ball area of said right insert; and said left insert tapers to said left minimum thickness forwardly across a rearward portion of said ball area of said left insert and tapers to said left minimum thickness rearwardly across a rearward portion of said heel area of said left insert.

12. A right insert and a left insert, as described in claim 11, wherein:

said right maximum thickness is approximately 1¼ inches; and said left maximum thickness is approximately ¾ inches.

13. A right insert for a right golf shoe for a right handed golfer and a left insert for a left golf shoe for a right handed golfer, each of said golf shoes having a right edge, a left edge, a heel area, an instep area, a ball area and a toe area, comprising:

a right insert formed to fit inside said right golf shoe having a platform area of a uniform platform thickness, a right tapering area tapering from said platform area to a right minimum thickness area of a uniform right minimum thickness, said right minimum thickness area extending from said right tapering area to cover all other portions of said right insert;

wherein said platform area covers only a portion of said heel area right of a platform area curve commencing at a rearmost point of a heel bisecting line substantially bisecting said heel area into a right portion and a left portion, said platform area curve extending forwardly and increasingly curving rightwardly and terminating at a point on said right edge just forward of said right portion of said heel area; and said right tapering area tapering to said right minimum thickness leftwardly from said platform area curve across only approximately two thirds of said left portion of said heel area and tapering to said right minimum thickness forwardly from said heel area to said ball area, said right tapering area being rightward of a right minimum thickness line commencing from a rearmost point on a line approximately bisecting said left portion of said heel and extending forwardly across said heel area and across approximately half of said instep area and then curving rightwardly and terminating at a point on said right edge in said ball area; and a left insert formed to fit inside said left golf shoe having a ridge area of a uniform ridge thickness, a left tapering area tapering from said ridge area to a left minimum thickness area of a uniform left minimum thickness, said left minimum thickness area extending from said left tapering area to cover all other portions of said left insert;

said ridge area covering only a portion of said heel area, said instep area and said ball area abutting against said right edge and rightward of a ridge area curve that commences in a middle portion of said heel area at said right edge, extends forwardly and leftwardly only approximately one fifth towards said left edge through said heel area and increasingly curving forwardly through said heel area, then extends forwardly through said instep area, and then increasingly curves rightwardly through said ball area and terminates at a point on said right edge in said ball area; and said left tapering area tapering to said left minimum thickness rearwardly from said ridge area in said heel area, leftwardly from said ridge area across only approximately three fourths of said heel area and instep area, and tapering to said left minimum thickness forwardly from said ridge area to said ball area, said left tapering area being rightward of a left minimum thickness line commencing from a rearward point on said left edge in said heel area and extending forwardly across said heel area and across approximately half of said instep area and then increasingly curving rightwardly and terminating at a point on said right edge in said ball area.

14. A left insert and a right insert for a pair of golf shoes for a left handed golfer, said left insert having a left heel area and a left instep area and said right insert having a right heel area and a right instep area comprising:

a left insert having a left maximum thickness in a leftward and rearward portion of said left heel area; and a right insert having a right maximum thickness in a leftward portion of said right instep area.

15. A left insert and a right insert, as described in claim 14, wherein said left insert and said right insert are formed of a resilient material.

16. A left insert and a right insert, as described in claim 15, wherein said left maximum thickness is approximately 1¼ inches and said right maximum thickness is approximately ¾ inches.

17. A left insert and a right insert, as described in any of claims 14, 15 or 16, wherein said left insert tapers from said left maximum thickness rightwardly across only a portion of said left heel area to a left minimum thickness and wherein said right insert tapers from said right maximum thickness rightwardly across only a portion of said right instep area to a right minimum thickness.

18. A left insert and a right insert, as described in claim 17, wherein said left minimum thickness and said right minimum thickness are both approximately ⅛ inch.

19. A left golf shoe having a left insole and a right golf shoe having a right insole for a left handed golfer, said left insole having a left heel area and a left instep area and said right insole having a right heel area and a right instep area, comprising:

a left golf shoe, wherein said left insole has a left maximum height in a leftward and rearward portion of said left heel area; and a right golf shoe, wherein said right insole has a right maximum height in a leftward portion of said right instep area.

20. A left golf shoe and a right golf shoe, as described in claim 19, wherein:

said left maximum height is approximately 1⅛ inches; and said right maximum height is approximately ⅝ inch.

21. A left golf shoe and a right golf shoe, as described in claim 19 or 20, wherein said left insole tapers from said left maximum height rightwardly across only a portion of said left heel area to a left minimum height and wherein said right insole tapers from said right maximum height rightwardly across only a portion of said right instep area to a right minimum height.

22. A left golf shoe and a right golf shoe, as described in claim 21, wherein said left insole and said right insole are formed of a resilient material.

23. A left insert and a right insert for a pair of golf shoes for a left handed golfer, each of said inserts having a heel area, an instep area, a ball area, a left edge and a right edge, comprising:

a left insert formed to fit inside a left golf shoe having a uniform left maximum thickness in a platform area in said heel area of said left insert, said platform area covering a leftward and rearward portion of said heel area of said left insert, said left insert tapering to a left minimum thickness rightwardly across a portion of said heel area of said left insert; and a right insert formed to fit inside a right golf shoe having a uniform right maximum thickness in a ridge area adjacent to said left edge of said right insert, said ridge area covering a left portion of said instep area of said right insert, said right insert tapering to a right minimum thickness rightwardly across a portion of said instep area of said right insert.

24. A left insert and a right insert as described in claim 23, wherein:

said left insert tapers to said left minimum thickness forwardly across said instep area and a rearward portion of said ball area of said left insert; and said right insert tapers to said right minimum thickness forwardly across a rearward portion of said ball area and tapers to said right minimum thickness rearwardly across a rearward portion of said heel area of said right insert.

25. A left insert and a right insert, as described in claim 24, wherein:

said left maximum thickness is approximately 1¼ inches; and said right maximum thickness is approximately ¾ inches.

26. A left insert for a left golf shoe for a left handed golfer and a right insert for a right golf shoe for a left handed golfer, each of said golf shoes having a left edge, a right edge, a heel area, an instep area, a ball area and a toe area, comprising:

a left insert formed to fit inside said left golf shoe having a platform area of a uniform platform thickness, a left tapering area tapering from said platform area to a left minimum thickness area of a uniform left minimum thickness, said left minimum thickness area extending from said left tapering area to cover all other portions of said left insert;

wherein said platform area covers only a portion of said heel area left of a platform area curve commencing at a rearmost point of a heel bisecting line substantially bisecting said heel area into a left portion and a right portion, said platform area curve extending forwardly and increasingly curving leftwardly and terminating at a point on said left edge just forward of said left portion of said heel area; and said left tapering area tapering to said left minimum thickness rightwardly from said platform area curve across only approximately two thirds of said right portion of said heel area and tapering to said left minimum thickness forwardly from said heel area to said ball area, said left tapering area being leftward of a left minimum thickness line commencing from a rearmost point on a line approximately bisecting said right portion of said heel and extending forwardly across said heel area and across approximately half of said instep area and then curving leftwardly and terminating at a point on said left edge in said ball area; and a right insert formed to fit inside said right golf shoe having a ridge area of a uniform ridge thickness, a right tapering area tapering from said ridge area to a right minimum thickness area of a uniform right minimum thickness, said right minimum thickness area extending from said right tapering area to cover all other portions of said right insert;

said ridge area covering only a portion of said heel area, said instep area and said ball area abutting against said left edge and leftward of a ridge area curve that commences in a middle portion of said heel area at said left edge, extends forwardly and rightwardly only approximately one fifth towards said right edge through said heel area and increasingly curving forwardly through said heel area, then extends forwardly through said instep area, and then increasingly curves leftwardly through said ball area and terminates at a point on said left edge in said ball area; and said right tapering area tapering to said right minimum thickness rearwardly from said ridge area in said heel area, rightwardly from said ridge area across only approximately three fourths of said heel area and instep area, and tapering to said right minimum thickness forwardly from said ridge area to said ball area, said right tapering area being leftward of a right minimum thickness line commencing from a rearward point on said right edge in said heel area and extending forwardly across said heel area and across approximately half of said instep area and then increasingly curving leftwardly and terminating at a point on said left edge in said ball area.

27. A process for improving a right handed golfer's balance and body position during a golf swing, comprising:

canting the right heel of said golfer leftwardly; and canting the instep of the left foot of said golfer leftwardly, wherein:

said canting of said right heel is performed by:

inserting under said right foot a right insert having a right heel area and a right instep area, said right insert having a right maximum thickness in a rightward and rearward portion of said right heel area; and said canting of said left instep is performed by:

inserting under said left foot a left insert having a left heel area and a left instep area, said left insert having a left maximum thickness in a rightward portion of said left instep area.

28. A process for improving a right handed golfer's balance and body position during a golf swing, as described in claim 27, wherein said left insert and said right insert are both formed of a resilient material.

29. A process for improving a right handed golfer's balance and body position during a golf swing, as described in claim 28, wherein said right maximum thickness is approximately 1¼ inches and said left maximum thickness is approximately ¾ inches.

30. A process for improving a right handed golfer's balance and body position during a golf swing, as described in claim 29, wherein said right insert tapers from said right maximum thickness leftwardly across only a portion of said right heel area to a right minimum thickness and wherein said left insert tapers from said left maximum thickness leftwardly across only a portion of said left instep area to a left minimum thickness.

31. A process for improving a right handed golfer's balance and body position during a golf swing, as described in claim 30, wherein said right minimum thickness and said left minimum thickness are approximately ¼ inch.

32. A process for improving a left handed golfer's balance and body position during a golf swing, comprising:

canting the left heel of said golfer rightwardly; and canting the instep of the right foot of said golfer rightwardly, wherein:

said canting of said left heel is performed by:

inserting under said left foot a left insert having a left heel area and a left instep area, said left insert having a left maximum thickness in a rightward and rearward portion of said left heel area; and said canting of said right instep is performed by:

inserting under said right foot a right insert having a right heel area and a right instep area, said right insert having a right maximum thickness in a leftward portion of said right instep area.

33. A process for improving a left handed golfer's balance and body position during a golf swing, as described in claim 32, wherein said left insert and said right insert are formed from a resilient material.

34. A process for improving a left handed golfer's balance and body position during a golf swing, as described in claim 33, wherein said left maximum thickness is approximately 1¼ inches and said right maximum thickness is approximately ¾ inch.

35. A process for improving a left handed golfer's balance and body position during a golf swing, as described in claim 34, wherein said left insert tapers from said left maximum thickness rightwardly across only a portion of said left heel area to a left minimum thickness and wherein said right insert tapers from said right maximum thickness rightwardly across only a portion of said right instep area to a right minimum thickness.

36. A process for improving a left handed golfer's balance and body position during a golf swing, as described in claim 35, wherein said left minimum thickness and said right minimum thickness are both approximately ¼ inch.

* * * * *